US005685510A

United States Patent [19]

Frankish

[11] Patent Number: 5,685,510

[45] Date of Patent: Nov. 11, 1997

[54] HEIGHT ADJUSTMENT SYSTEM FOR A DESK OR WORKSTATION

[75] Inventor: Roger Graham Frankish, Templestowe, Australia

[73] Assignee: Prima Furniture (Aust) Pty Ltd, Tullamarine, Australia

[21] Appl. No.: 400,605

[22] Filed: Mar. 8, 1995

[51] Int. Cl.[6] ..... F16M 11/24

[52] U.S. Cl. ..... 248/188.4; 74/89.13; 108/147; 248/405; 384/37; 384/38; 384/39

[58] Field of Search ..... 248/188.2, 188.4, 248/188.5, 404, 405; 108/147; 384/39, 38, 37; 74/89.13, 89.15

[56] References Cited

U.S. PATENT DOCUMENTS

| | | | |
|---|---|---|---|
| 1,783,661 | 12/1930 | Makoski et al. | 108/147 |
| 2,368,748 | 2/1945 | Doty | 108/147 |
| 3,210,846 | 10/1965 | Balkin | 108/147 |
| 3,253,284 | 5/1966 | St. John | 108/147 |
| 4,515,414 | 5/1985 | Werth, Jr. | 384/39 |
| 4,593,874 | 6/1986 | Dunagan | 248/188.4 |
| 4,702,621 | 10/1987 | Heinonen et al. | 384/39 X |
| 4,940,339 | 7/1990 | Amano | 384/39 X |
| 4,957,376 | 9/1990 | Ward, Jr. | 384/39 X |
| 5,022,327 | 6/1991 | Solomon | 108/147 |
| 5,031,869 | 7/1991 | Strater et al. | 248/188.4 X |

FOREIGN PATENT DOCUMENTS

| | | |
|---|---|---|
| 246818 | 10/1962 | Australia . |
| 580366 | 6/1986 | Australia . |
| 632297 | 2/1990 | Australia . |

*Primary Examiner*—Alvin C. Chin-Shue
*Assistant Examiner*—Derek J. Berger
*Attorney, Agent, or Firm*—Christensen O'Connor Johnson & Kindness PLLC

[57] ABSTRACT

A height adjustment system for a desk, workstation or the like is provided comprising a plurality of height adjustable legs each having a first part in the form of a hollow column and a second part movable relative to the first part in a vertical direction. The second part of each leg includes a gearbox housing containing a crown gear provided on a vertically extending rotatable shaft and at least one pinion gear engageable with said crown gear. The vertical shaft includes a screw-threaded portion engaged by nuts on a base plate of the column. A winding mechanism is provided for rotating a horizontally extending shaft on which the pinion gear is provided. Rotation of the horizontal shaft causes the vertical shaft to rotate thereby moving the second part relative to the column so adjust the height of a top member secured on the gearbox housing. The gearbox housing includes ball bearing race assemblies for the crown and pinion gears which enable the height or two or more legs to be adjusted simultaneously by a single winding mechanism. The leg also includes a self-adjusting linear bearing between telescopically movable parts of the leg.

28 Claims, 10 Drawing Sheets

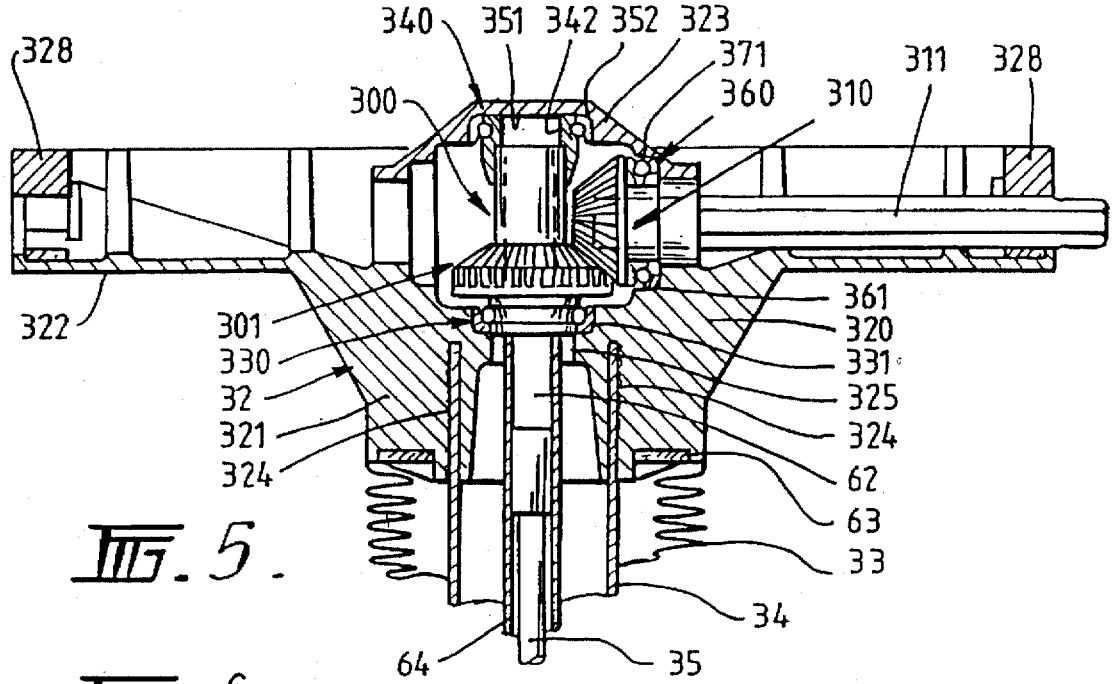
FIG. 5.
FIG. 6.
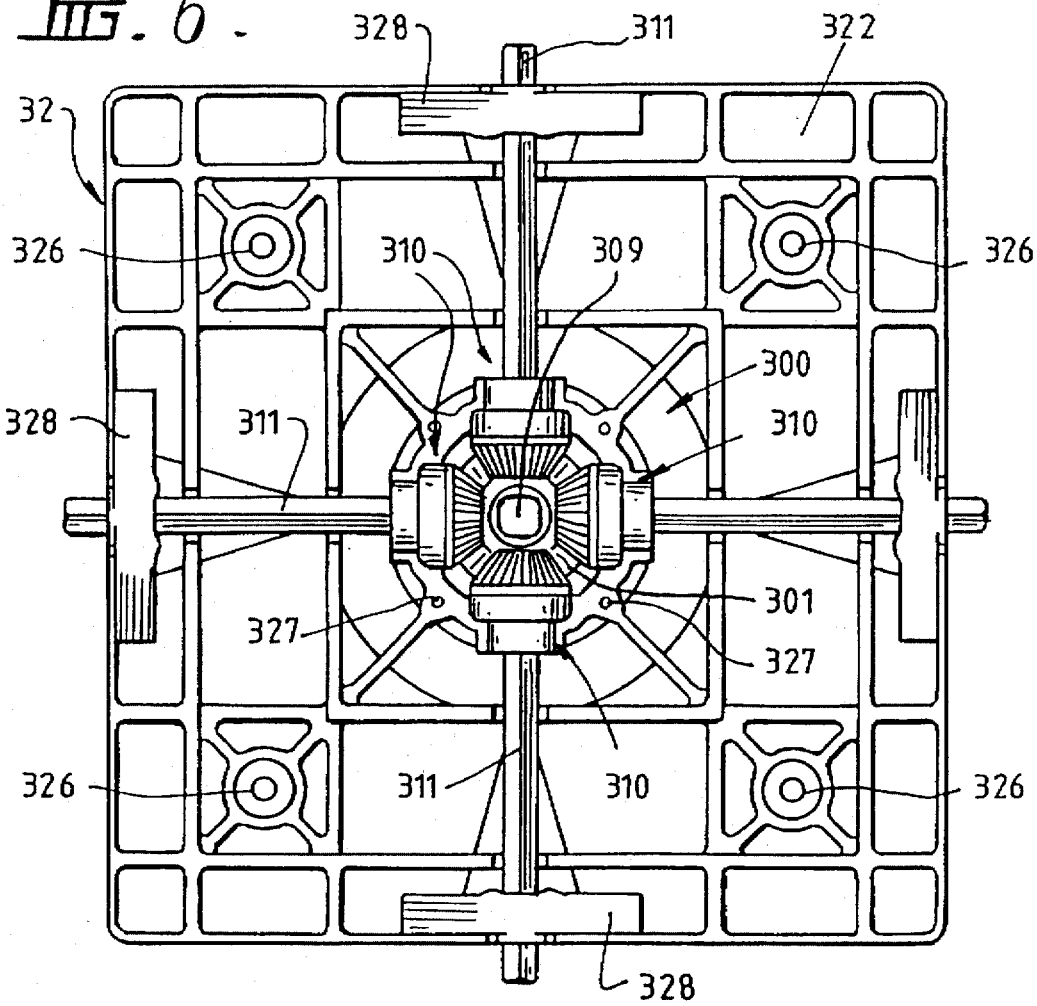

HEIGHT ADJUSTMENT SYSTEM FOR A DESK OR WORKSTATION

This invention relates to height adjustable legs for a height adjustment system for desks, workstations and the like.

Australian Patent No. 632297 discloses a desk height adjustment mechanism for a desk top member comprising a pair of leg members each having a first leg part fixed to the desk top member and a second leg part movable vertically relative to the first leg part to adjust the height of the desk top member relative to the leg. The first part of each leg has a rotatable vertically extending screw with a bevel gear at its upper end and the second part of each leg includes a nut engaged with the rotatable screw of the first leg part. The adjustable mechanism includes a horizontal rotatable shaft extending between the leg members and having a bevel gear at each end of the shaft engageable with the bevel gear of a respective rotatable screw, and drive means including a right-angle gearbox is provided for rotating the shaft to adjust the height of the legs simultaneously.

Australian Patent No. 632297 also discloses that the height of more than two legs can be adjusted simultaneously if the bevel gear at the top of the rotatable screw of at least one leg is engageable with bevel gears on two rotatable shafts extending perpendicularly relative to each other from said one leg to two other legs, said other legs having a respective rotatable vertical screw with a bevel gear at its upper end. However, it was found that the height adjustment system of Australian Patent No. 632297 did not operate satisfactorily when it was required to adjust the height of more than two legs simultaneously because of excessive frictional forces between relatively movable components of the system.

It is therefore deskable to provide an effective height adjustment system for multi-leg desks, workstations and the like which enables the height of two or more legs of the desk or workstation to be adjusted simultaneously.

It is also desirable to provide a height adjustable leg for desks, workstations or the like which has improved bearings between relatively movable components of the leg.

It is further desirable to provide an efficient, self-adjusting linear bearing for use in a height adjustable leg or other device which has parts which are movable relative to each other in a linear direction.

According to a fast aspect of the invention three is provided a height adjustable leg for a desk, workstation or like apparatus, the leg comprising a first leg part adapted to stand on a floor surface; and a second leg part adapted to be fixed to a top member of said desk, workstation or like apparatus, said second leg part being movable relative to said first leg part in a substantially vertical direction, said second leg part including a gearbox housing containing a crown gear rotatable about a substantially vertical axis and at least one pinion gear engageable with said crown gear about a substantially horizontal axis, said gearbox housing containing at least one ball bearing race assembly provided between said gearbox housing and at least one of said gears.

The gearbox housing may be formed in two parts and conveniently comprises a housing base member and a gearbox cover member.

The first leg part preferably comprises a substantially vertically extending hollow column and the second leg part includes a rotatable shaft extending vertically within the column and on which the crown gear is mounted.

The vertically extending rotatable shaft preferably has a screw-threaded portion and the first leg part, conveniently a base plate secured to the column, includes a nut engaged with said screw-threaded portion.

A pinion gear of the gearbox is preferably provided on a rotatable shaft which extends substantially horizontally out of the gearbox housing and which is adapted to be connected to drive means for rotating said horizontally extending rotatable shaft and the pinion gear. Rotation of the pinion gear causes rotation of the crown gear and the vertically extending shaft and rotation of the screw portion of the shaft causes the second leg part to move substantially vertically relative to the first leg part thereby adjusting the height of the top member of the desk or workstation supported by the height adjustable leg According to a second aspect of the invention there is provided a height adjustment system for a desk, workstation or like apparatus comprising at least one height adjustable leg in accordance with the first aspect of the invention, a desk- or work-top member or the like secured to said second leg part of the leg, and drive means connected to a pinion gear of the gearbox housing of the leg for rotating said pinion gear to cause the second leg part to more substantially vertically relative to the first leg part of the leg thereby adjusting the height of the desk- or work-top member.

The gearbox housing preferably includes a crown gear ball bearing race assembly provided between said crown gear and the gearbox housing, and a pinion gear ball bearing race assembly provided between the pinion gear and the gearbox housing.

The ball bearing race assemblies of the gearbox housing preferably include a first bearing race member having a substantially part-spherical concave surface, a second bearing race member having a substantially part-spherical concave surface and a plurality of ball bearings received between said concave surfaces of the first and second bearing race members.

The bearing race members of the ball bearing race assemblies arc preferably formed from a low-friction plastics material. The crown and pinion gears may also be formed as mouldings of plastics material. The provision of gears and ball bearing race assemblies formed from a low-friction plastics material facilitates low cost production of very efficient gearboxes allowing more than one height adjustable leg of a height adjustment system for a desk or workstations to be driven from a single drive mechanism.

According to another aspect of the invention there is provided a height adjustment system for a desk, workstation or like apparatus comprising a plurality of height adjustable legs in accordance with the first aspect of the invention, the second part of each leg being secured to a generally horizontally extending top member, wherein the gearbox housing of at least one of said height adjustable legs includes a plurality of pinion gears engaged with the crown gear of the gearbox, one of said pinion gears being connected to drive means for rotating said pinion gear and the other pinion gear or gears being connected by drive transmission means to a pinion gear of another height adjustable leg of the system.

The second leg part of a height adjustable leg in accordance with the invention preferably includes a tubular member secured to and extending downwardly from the gearbox housing to surround the rotatable vertical shaft. In another advantageous feature of the invention a pair of low friction half nuts are received on the screw-threaded portion of said shaft and attached to the tubular member to assist in locating the shaft within the tubular member.

In accordance with a further advantageous feature of the invention at least one adjustable linear bearing is provided between the hollow column of the leg and the tubular member which is telescopically movable within the column in a substantially vertical direction. The adjustable linear bearing preferably comprises a bearing body fixed to one of the telescopically movable parts of the leg, said bearing body having upper and lower expanable regions providing bearing surfaces for the other telescopically movable part of the leg, and upper and lower wedge members received in respective recesses in said upper and lower regions for expanding said regions to compensate for wear of said bearing surfaces.

According to another aspect of the invention there is provided an adjustable linear bearing for a height adjustable leg or other device having first and second parts which are movable relative to each other in a linear direction, said linear bearing comprising a bearing body adapted to be fixed to one of said relatively movable parts of the device and having first and second longitudinally spaced expandable bearing regions, each bearing region providing a bearing surface for said other part of the device; and first and second wedge members received in respective recesses in said first and second bearing regions and adapted to expand said bearing regions of the bearing body to compensate for wear of said bearing surfaces.

Preferably, the linear bearing further comprises spring means for urging at least one of said wedge members into its recess in a respective one of said bearing regions so that the bearing automatically compensates for wear of the bearing surface of said bearing region.

The first and second wedge members of the linear bearing are preferably connected together in such a manner that said spring means urges both of said wedge members into their respective recesses in said first and second bearing regions.

In a particularly preferred embodiment, the linear bearing further comprises an elongate connecting member attached to said first wedge member and extending through a bore in said second wedge member, and spring means received on said elongate connecting member and arranged to urge said first and second wedge members into their respective recesses in said first and second bearing regions, whereby said linear bearing is automatically self-adjusting to compensate for wear of said bearing surfaces of said bearing regions.

The bearing body and the wedge members may be conveniently formed from a low friction plastics material, the wedge members having an angle of taper less than the friction angle of said low friction plastics material.

A preferred embodiment of the present invention will now be described, by way of example only, with reference to the accompanying drawings, in which:

FIG. 5 is an enlarged sectional view through a gearbox at the upper end of the leg of FIG. 1;

FIG. 6 is a top plan view of the gearbox of FIG. 5 with its cover removed;

Figure 1:
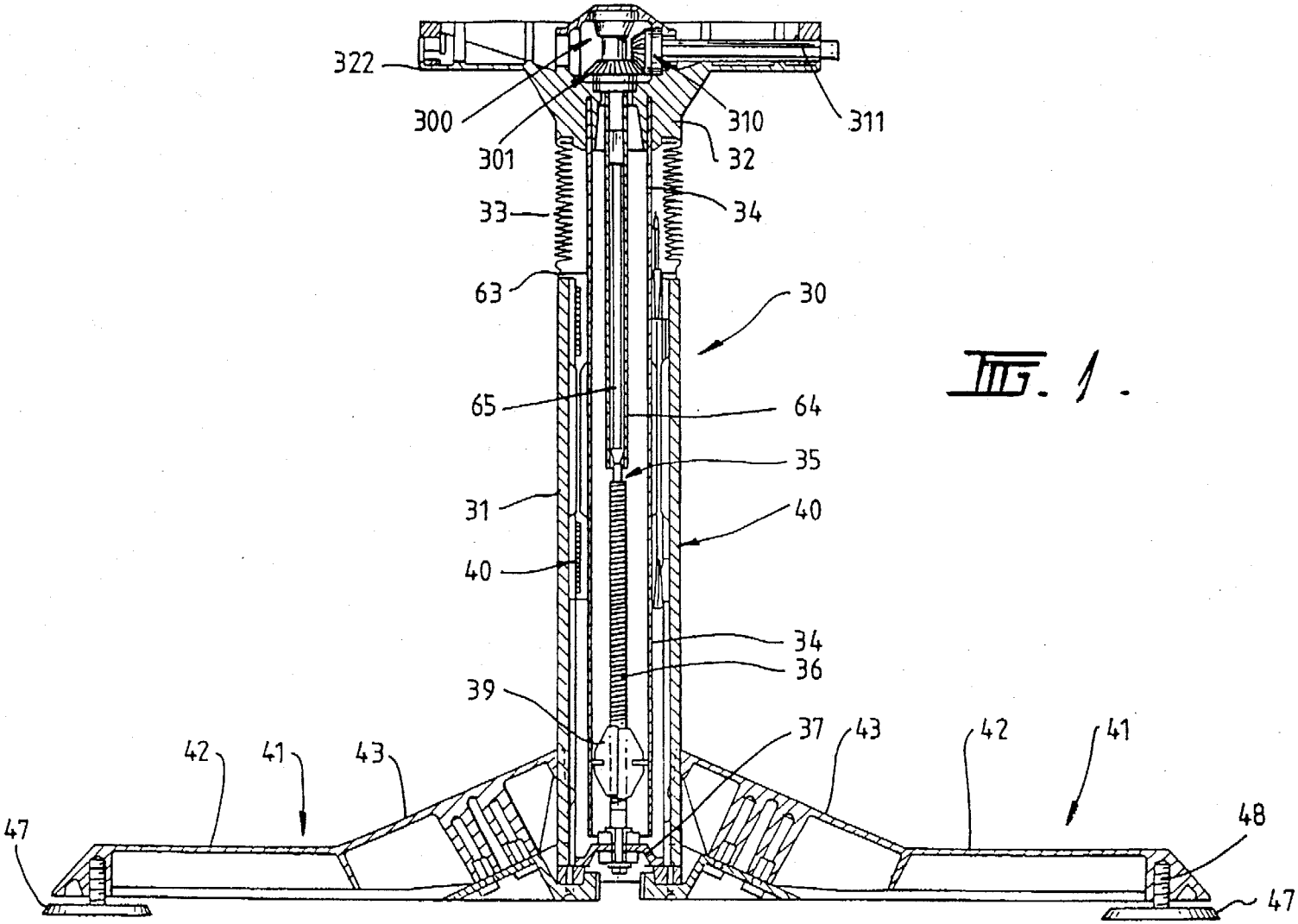
FIG. 1 is a section through a height adjustable leg of a height adjustment system in accordance with the invention.

The height adjustment system shown in the drawings comprises a desk- or work-top member 10 supported by a plurality of height adjustable legs 20, 30, 30' each incorporating a right-angle gearbox 200, 300, 300' at its upper end and a drive mechanism 50 arranged to adjust the height of the legs simultaneously.

Figure 3:
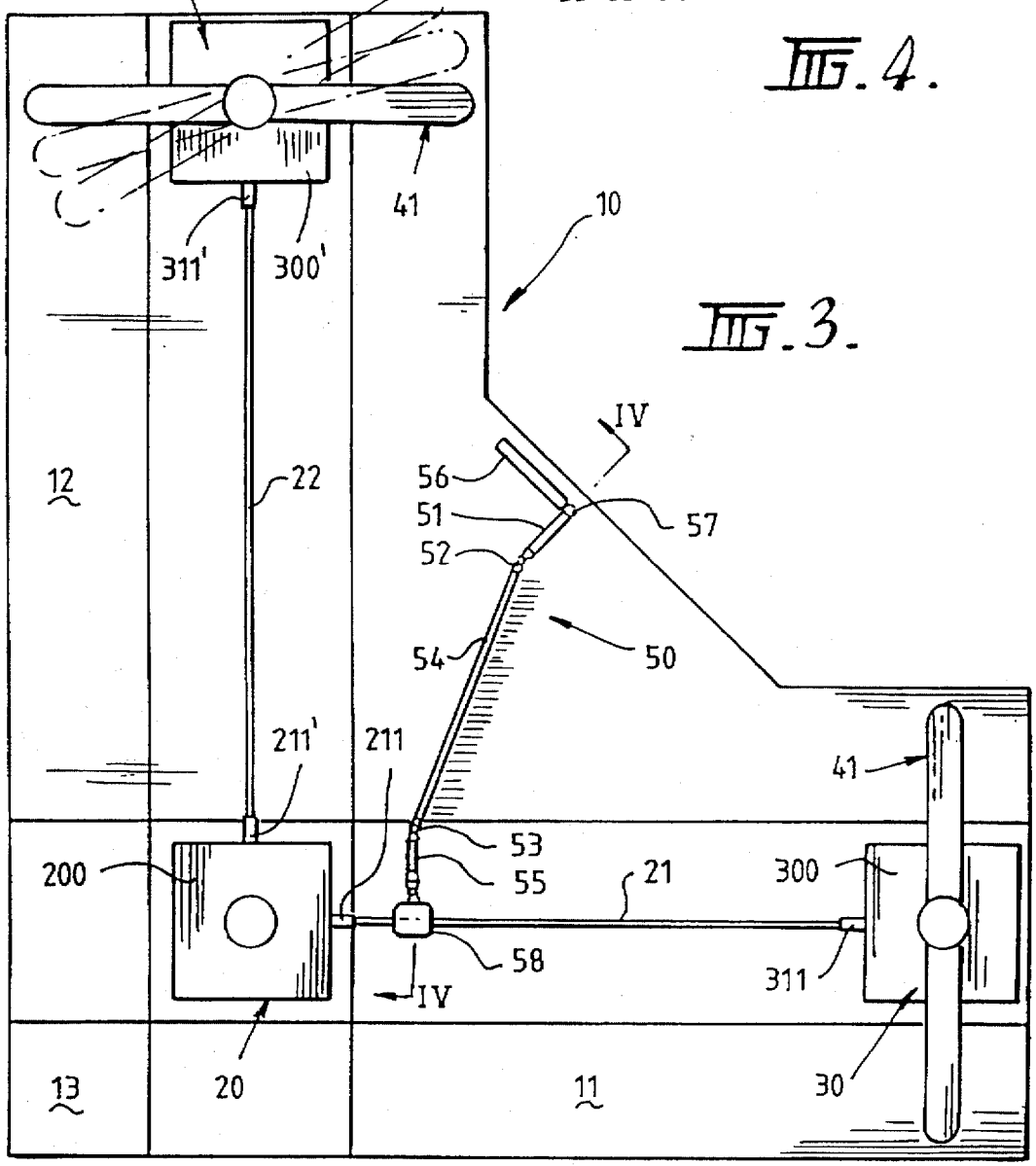
FIG. 3 is a schematic underneath plan view of a height adjustment system incorporating a plurality of height adjustable legs of the kind shown in FIG. 1.
Figure 2:
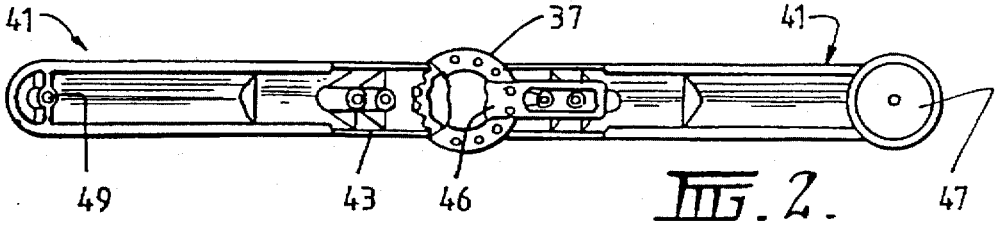
FIG. 2 is an underneath view of the height adjustable leg of FIG. 1.

The top member 10 shown in FIG. 3 is substantially L-shaped having first and second limbs 11 and 12 extending in perpendicular directions. The leg 20 supporting the corner region 13 of the L-shaped work top member 10 has a right-angle gearbox 200 from which two shafts 211, 211' extend in perpendicular directions. The ends of the shafts 211, 211' are connected to the ends of respective rotatable transmission members 21, 22 which extend along the undersurface of the top member 10. The opposite ends of the transmission members 21, 22 are connected to ends of rotatable shafts 311, 311' which extend out of right-angle gearboxes 300, 300' at the upper ends of the legs 30, 30'. It will, however, be appreciated that in a height adjustment system in accordance with the invention the top member may be of any desired shape and be supported by any number of height adjustable legs each having a right-angle gearbox connected to the right-angle gearbox of at least one other leg and/or to the drive mechanism.

FIG. 1 of the drawings shows one of the legs 30 of the system in section. The leg 30 has a first leg part in the form of a hollow cylindrical upright column 31 preferably formed from aluminum and a relatively movable second leg part in the form of an inner tubular member 34 secured to a housing 32 for the right-angle gearbox 300 at the upper end of the leg 30.

The upper end of the column 31 is connected to the lower end of the gearbox housing 32 by an expandable bellows member 33 which allows the gearbox housing 300 to move in a vertical direction relative to the column 31. The bellows member 33 is preferably formed from PVC and may be secured to the gearbox housing 32 and to the upper end of the column 31 by a self-anchoring bellows plate 63 or any other convenient attachment means. The tubular member 34 is preferably formed of steel and is secured to and extends downwardly from the gearbox housing 32 inside the hollow column 31.

Figure 18:
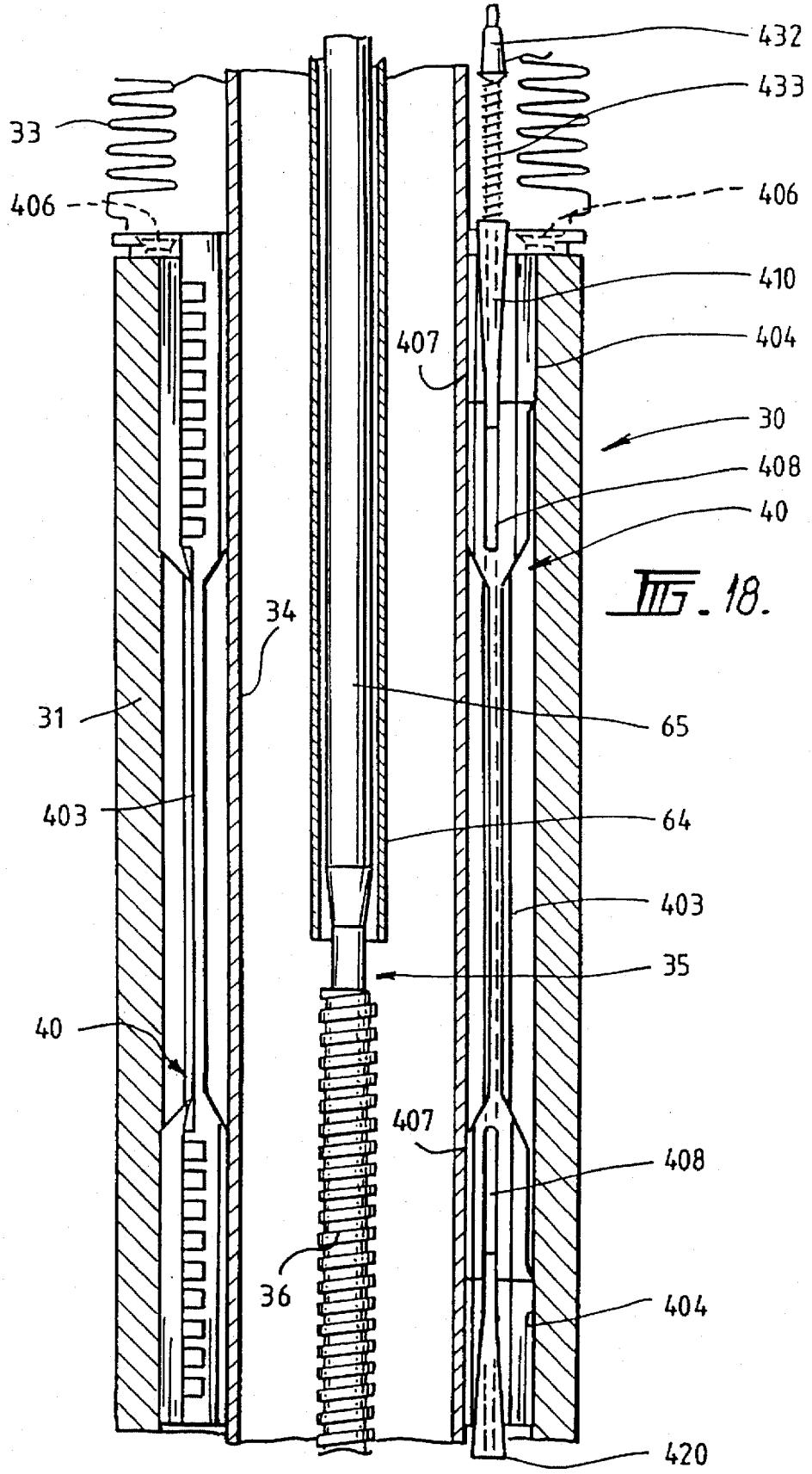
FIG. 18 is a section through the middle region of the height adjustable leg of FIG. 1 which includes a self-adjusting linear bearing assembly.
Figure 19:
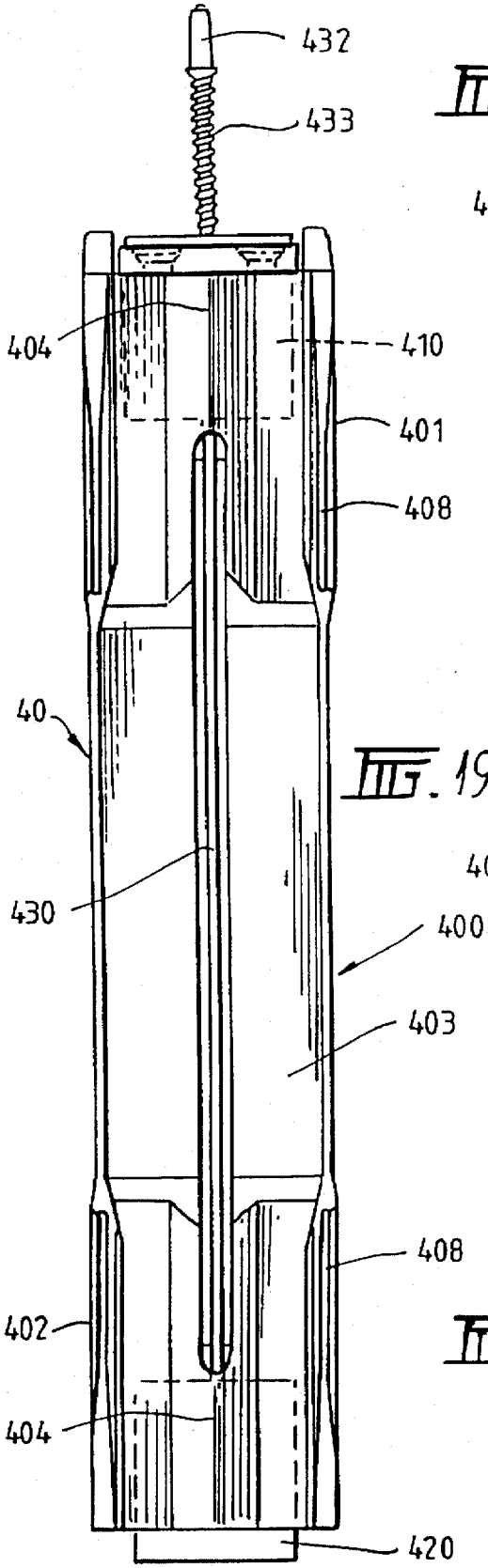
FIG. 19 is a side view of the linear bearing assembly.
Figure 27:
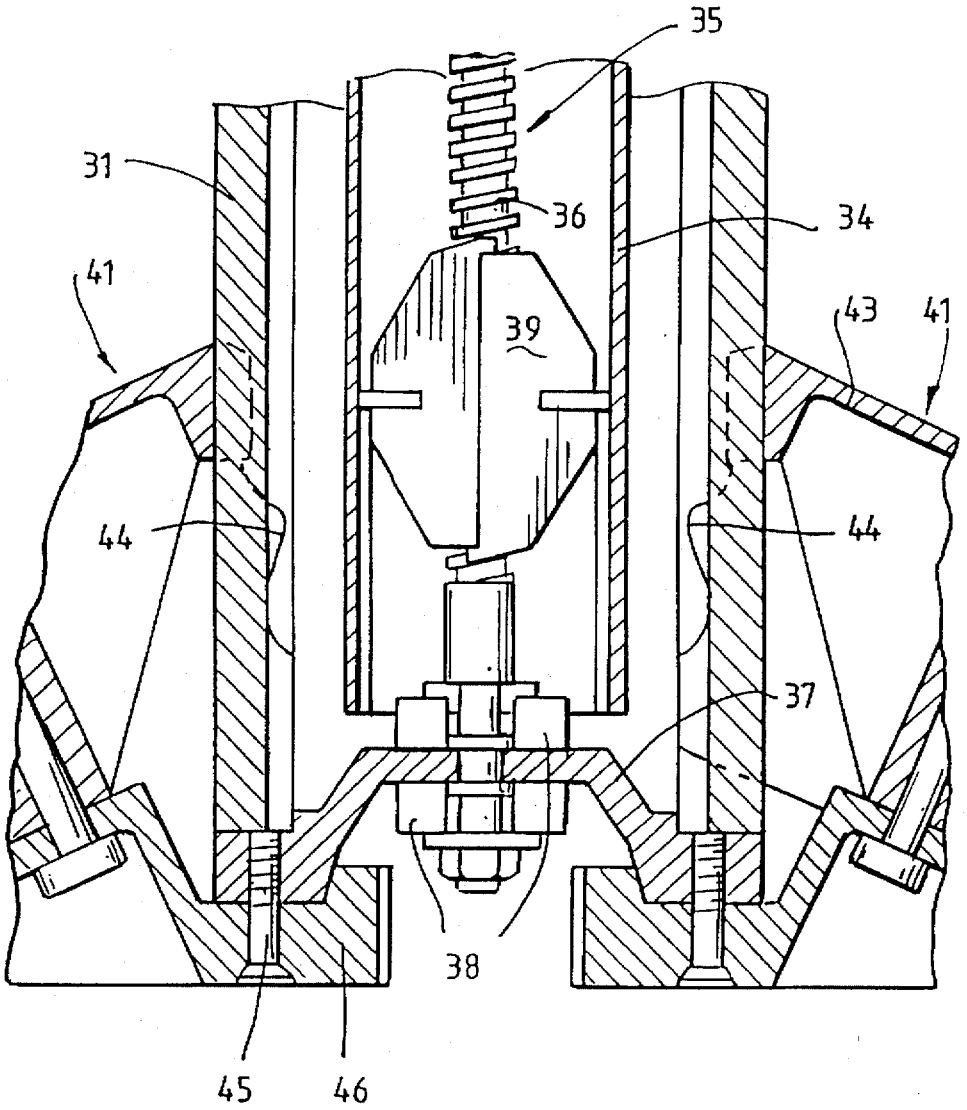
FIG. 27 is a section through the lower region of the height adjustable leg of FIG. 1.
Figure 29:
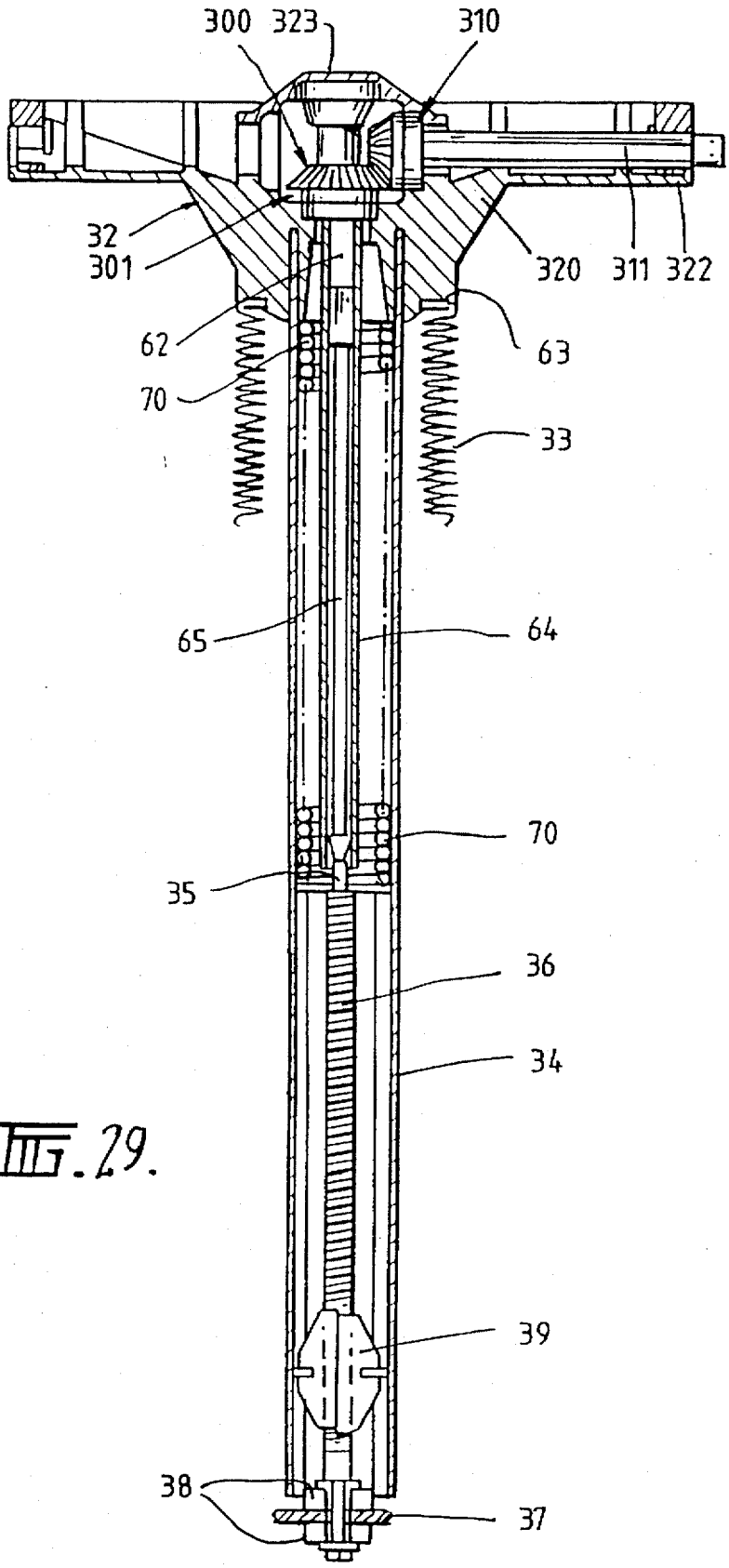
FIG. 29 is a section through the gearbox housing and an internal tube member of the leg which are vertically movable relative to the outer column, base and feet of the leg.

As shown more particularly in FIGS. 18, 27 and 29, a rotatable shaft 35 extends vertically within the steel tube 34 and has an upper portion 64 and a lower portion in the form of a screw 36. The lower end of the screw portion 36 extends through an aperture in a base plate 37 fixed to the column 31 and is received by nuts 38 on the base plate 37. A pair of glass-filled nylon half nuts 39 attached to the internal wall of the steel tube 34 assist in locating the screw 36 within the tube while enabling the screw 35 to rotate to cause the steel tube 34 and gearbox housing 300 to move vertically relative to the column 31 and base plate 37. The glass-filled nylon half nuts 39 provide a generous bearing area and relatively low friction. Vertical movement of the inner steel tube 34 relative to the hollow column 31 is also guided by at least one linear bearing 40 provided between the external surface of the steel tube 34 and the internal surface of the column 31.

The upper portion 65 of the shaft 35 is housed within a tubular member 64 and, as illustrated in FIG. 29, a compression spring 70 may be provided within the steel tube 34 and surrounding the tubular member 64. Such a compression spring 70 can compensate for external loads in the leg 30. The spring 70 is retained between the lower part of the gearbox housing 32 and the base plate 37 in such a manner that it is not rotatable and is fully supported within the steel tube 34 to prevent buckling of the leg column 31.

As shown in FIGS. 1 and 27 a pair of stabilizing feet 42 are attached to the column 31 at its lower end. Each foot 41 is of elongate form having a horizontally extending portion 42 and an upwardly inclined ankle portion 43. The ankle portion 43 is attached to the column 31 by vertically extending flutes 44 received in key apertures in the column 31 and by bolts or screws 45 which extend through a base part 46 of the ankle portion 43 and the base plate 37 to secure the column 31 to the base plate 37. The key effect of the vertically extending flutes 44 eliminates rotation of the feet 41 relative to the column and ensures play-free lateral stability of the top member 10. A plurality of key apertures may be spaced around the circumference of the column 31 to provide different alternative locations for the feet 41.

In a particularly preferred embodiment, the key apertures are provided at 15° increments around the column to permit 24 alternative positions for the feet. Furthermore, for additional stability, it will be appreciated that more than two feet may be attached to the column, for instance, the leg may have three feet extending from the column at 120° relative to each other, or four feet extending at 90° relative to each other.

Figure 28:
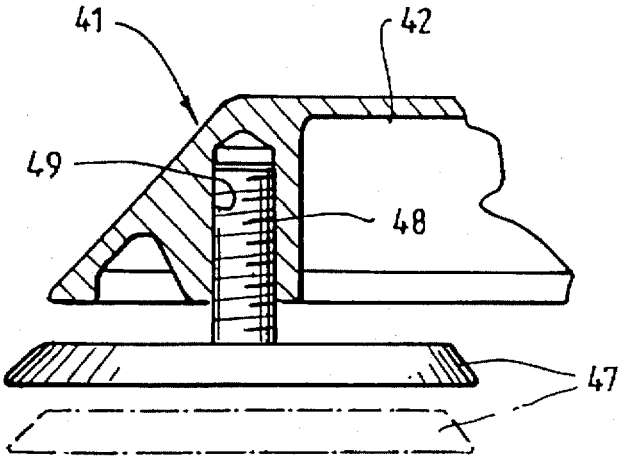
FIG. 28 is a section through a toe part of a foot of the height adjustable leg.

As shown in FIG. 28, at the end of each foot 41 there is provided an adjustable toe pad 47 having a screw-threaded upright rod 48 received in an internally screw-threaded aperture 49 in the foot 41 so that each foot 41 is independently adjustable relative to the floor to allow for unevenness in the floor surface.

Referring more particularly to FIGS. 5 and 6, the gearbox housing 32 for the right-angle gearbox 300 comprises a housing base 320 and a housing cover 323. The housing base 320 has a frusto-conical lower portion 321 and a generally square-shaped upper portion 322. The housing base 320 and cover 323 may be formed from any convenient material, but are preferably formed from cast aluminum. The lower portion 321 of the housing base has an annular recess 324 in its lower surface which receives the upper end of the steel inner tube 34. The housing base 320 may be conveniently secured to the tube 34 by filling the recess 324 around the upper end of the tube with an epoxy resin to form a bonded joint which simulates a collet-type fixing and eliminates free-play, spreading loads to minimize stress concentrations and eliminating interleg bracing.

The upper square-shaped housing portion 322 is provided with four bosses 326, one at each corner, which enable the gearbox housing 32 to be secured to the top member 10, for instance by fixing screws or the like. The bosses 326 are preferably of a self-limiting type so that destructive over-tightening of the attachment screws is substantially avoided to protect the casting from unnecessary internal stresses.

The right-angle gearbox 300 includes a crown gear 301 mounted on the upper end of the vertical shaft 35 so as to be rotatable with the shaft 35 about a substantially vertical axis. The vertical shaft 35 extends through a central opening 325 in the lower housing portion 321 and the crown gear 301 is supported for rotation relative to the lower housing portion 321 by a crown gear bearing race assembly 330.

As shown more particularly in FIGS. 7 to 9 and FIG. 13, the crown gear 301 comprises a central bevelled portion 302 having a plurality of gear teeth 303 thereon, a cylindrical upper shaft portion 304 extending upwardly from the central portion 302 and a stepped lower spigot 305 having an arcuate grove 306 in its external surface disposed between an upper portion 307 of greater diameter adjacent the central portion and a lower portion 308 of lesser diameter at the lower end of the spigot 305.

Figure 7:
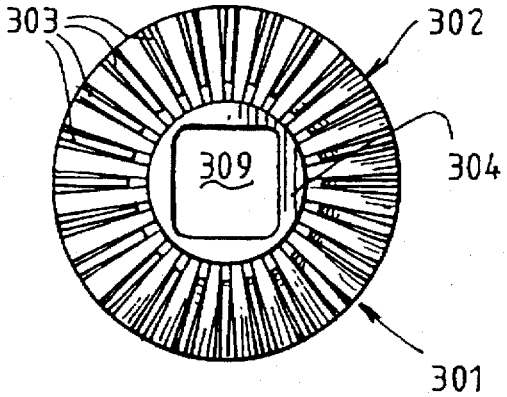
FIG. 7 is a top plan view of the crown gear of the gearbox of FIG. 5.
Figure 8:
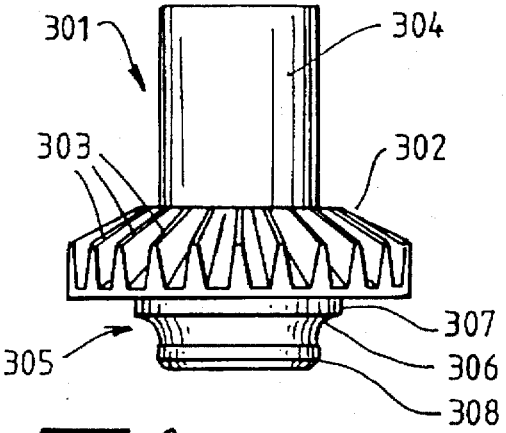
FIG. 8 is a side elevation of the crown gear.
Figure 9:
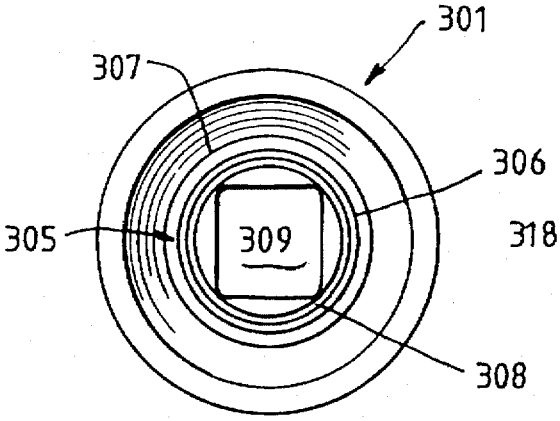
FIG. 9 is an underneath plan view of the crown gear.

The crown gear 301 is of hollow form having a bore 309 of square section extending vertically through the upper portion 304, the central portion 302 and the spigot 305. The square-section bore 309 is adapted to receive an upper shaft extension 62 which is also of square-section for mounting the crown gear 301 on the shaft 35. The crown gear 301 is preferably moulded from plastics material and, as shown in FIGS. 7 to 9, has 24 gear teeth 303 although it will be appreciated that the number of gear teeth may vary for different applications.

The bearing race assembly 330 for the crown gear 301 comprises a plurality of ball bearings 333 and an annular dish-shaped bearing member 332 received in a complementary shaped recess 331 in the surface of the gearbox housing lower portion 321 surrounding the central opening 325. The annular bearing member 332 has a substantially cylindrical outer surface 334 and an internal surface having an arcuate surface section 336 disposed between an cylindrical section 338 of greater internal diameter and a cylindrical section 339 of lesser internal diameter. The ball bearings 333 are therefore received in a bearing race between the arcuate surfaces 305 and 336.

Figure 17:
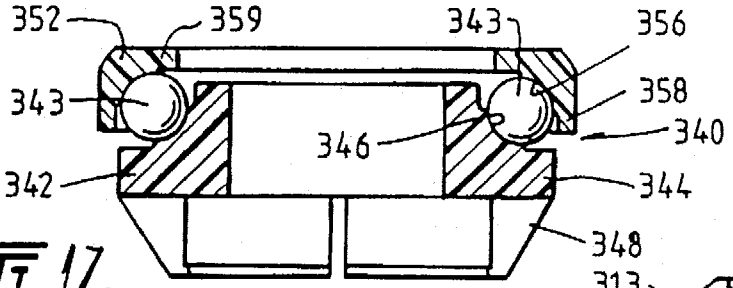
FIG. 17 is an enlarged section through a bearing race between the gearbox and the gearbox.
Figure 13:
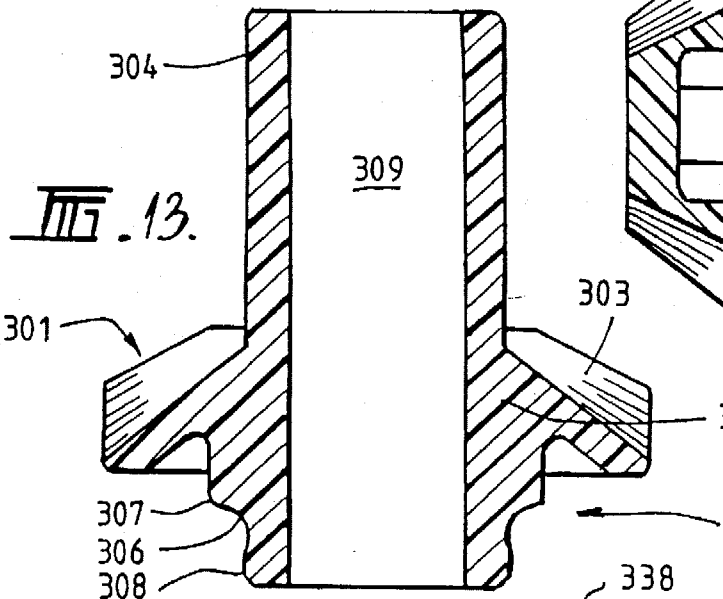
FIG. 13 is an enlarged section through the crown gear.
Figure 15:
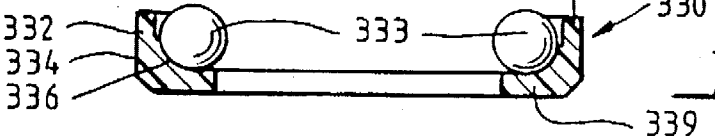
FIG. 15 is an enlarged section through a bearing race between the crown gear and the gearbox housing.

An upper bearing race assembly 340 similar to the bearing race assembly 330 is provided between the upper end of the shaft portion 304 of the crown gear 301 and the gearbox housing cap 323. The upper bearing race assembly 340 comprises a plurality of ball bearings 343 received in a ball race provided between a first annular bearing race member 342 and a second annular bearing race member 352. Referring more particularly to FIG. 17 the first bearing race member 342 is of annular form having an upper annular portion 344 of smaller internal diameter providing an upwardly and outwardly facing arcuate bearing surface 346 and a lower splined portion 348 of greater internal diameter adapted to fit over and be secured to the upper end of the shaft portion 304 of the crown gear 301. The second bearing race member 352 is of similar form to the annular bearing member 332 and has an arcuate surface section 356 disposed between a cylindrical section 358 of greater internal diameter and a cylindrical section 359 of lesser internal diameter. In use, the second bearing race member 352 is received in a complementary dish-shaped recess 351 in the lower surface of the gearbox housing cap 323 so that the arcuate surface 356 faces downwardly and inwardly with the ball bearings 343 being received in a bearing race between the arcuate surfaces 346 and 356.

The gearbox 300 also includes at least one pinion gear 310 engageable with the crown gear 301 and mounted on the end of a rotatable horizontal shaft 311 which extends in a horizontal direction out of the gearbox housing 32. The horizontal shaft 311 is conveniently of hexagonal section and is rotatably supported by a bush 328 at the side of the upper housing portion 322. As shown in FIG. 6, up to four horizontal shafts 311 each carrying a pinion gear 310 engageable with the crown gear 301 may be provided, but only one shaft 311 and pinion gear is illustrated in FIG. 5.

As shown more particularly in FIGS. 10 to 12 and 14, the pinion gear 310 comprises a bevelled portion 312 having a plurality of gear teeth 313 thereon and a stepped spigot 315 having an internal bore 319 of hexagonal section adapted to receive an end of the hexagonal horizontal shaft 311 for mounting the pinion gear 310 on the shaft 311. The spigot 315 has a stepped shoulder 316 disposed between a cylindrical portion 317 adjacent the bevelled portion 312 and the wider end of a slightly frusto-conical portion 318. The cylindrical portion 317 is adapted to receive a bearing race member 361 of a pinion gear bearing race assembly 360 as illustrated in FIG. 16.

Figure 10:
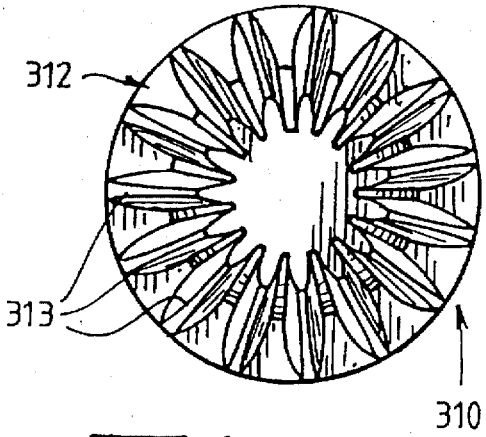
FIG. 10 is a front elevation of a pinion gear of the gearbox of FIG. 5.
Figure 11:
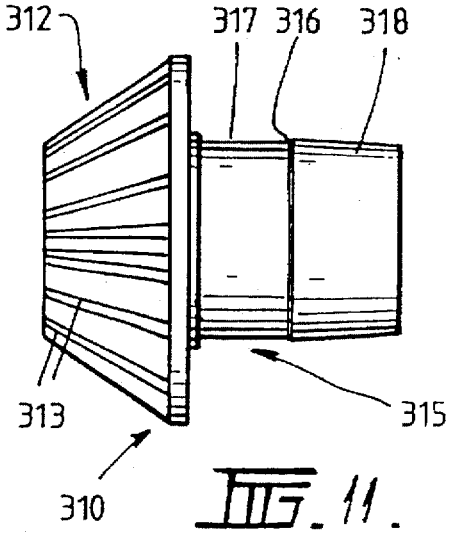
FIG. 11 is a side elevation of the pinion gear of FIG. 10.
Figure 12:
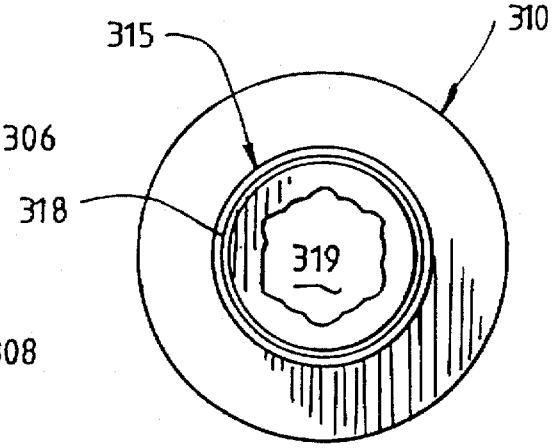
FIG. 12 is a rear elevation of the pinion gear.

The pinion gear 310 may also be conveniently formed as a plastics moulding and, as shown in FIGS. 10 to 12, has fifteen gear teeth 313 although it will be appreciated that the number of gear teeth may vary for different applications.

Figure 16:
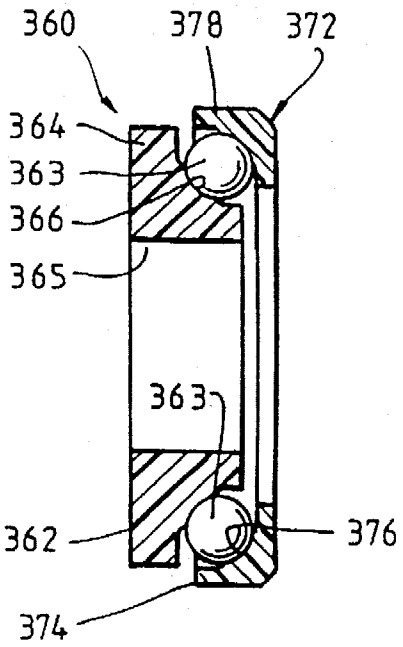
FIG. 16 is an enlarged section through a bearing race adapted to be mounted on the pinion gear.
Figure 14:
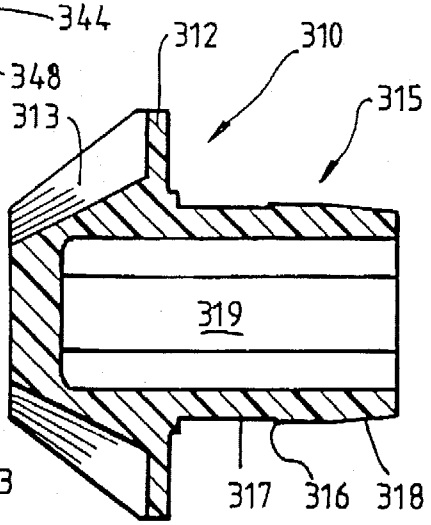
FIG. 14 is an enlarged section through the pinion gear.

Referring more particularly to FIG. 16, the bearing race assembly 360 for the pinion gear 310 comprises a plurality of ball bearings 363 in a ball race provided between first and second annular bearing race members 362 and 372. The first bearing race member 362 is of annular form having a cylindrical bore 365 of an internal diameter corresponding to the external diameter of the cylindrical portion 317 of the spigot 315. The external surface: of the bearing race member 362 has an arcuate surface section 366 disposed between a cylindrical section 364 of greater external diameter and cylindrical section 368 of lesser external diameter. The second annular bearing race member 372 is similar form to the bearing race members 332 and 352 having a substantially cylindrical outer surface 374 and an internal surface including an arcuate surface section 376 between a cylindrical section 378 of greater internal diameter and a section of lesser internal diameter 379.

In use, the bearing race member 362 is secured on the cylindrical portion 317 of the pinion gear 310 and the bearing race member 372 is received in a dish-shaped recess around the spigot 315 of the pinion gear 310 provided by a part-circular recess 361 in the housing base 321 and by a part-circular recess 371 in the housing cap 323. The cap 323 of the gearbox housing 32 is secured to the housing base 321, for instance by fixing screws received in screw holes 327 in the base 321, and therefore retains the bearing race assemblies 350 and 370 securely in the gearbox housing 32.

The crown and pinion gears 301, 310, and the bearing race members 332, 342, 352, 362, 372 of the bearing race assemblies 330, 340 and 360 are conveniently moulded from a low friction plastics material, such as an acetyl resin, nylon, PTFE or the like, so as to provide low friction bearings for the crown and pinion gears 301 and 310. This is particularly advantageous in a height adjustment system such as illustrated in FIGS. 3 and 4 in which a single drive mechanism 50 is used to adjust the height of a plurality of legs simultaneously.

Figure 4:
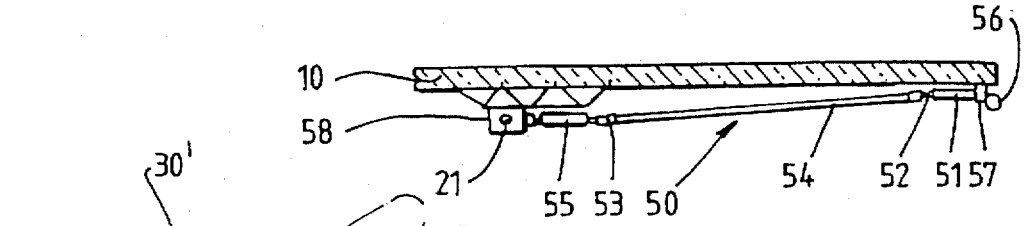
FIG. 4 is a section on the line IV—IV of FIG. 3 showing the drive mechanism for the height adjustment system.

As shown in FIGS. 3 and 4, the drive mechanism 50 comprises a winding mechanism including a rotatable drive shaft 51 linked by universal joints 52 and 53 and a rust rotatable transmission member 54 to a driven shaft 55. The driven shaft 55 is connected to the rotatable drive transmission member 21, e.g. by a right-angle drive gearbox 58, in such a manner as to rotate the transmission member 21 when the winding mechanism is operated. A retractable handle 56 is connected by a universal joint 57 to the drive shaft 51 for manual operation of the winding mechanism, but it will be appreciated that different types of drive mechanisms, for instance a drive mechanism including an electric motor drive, may be provided instead of a manually operable winding mechanism.

When the drive mechanism 50 is operated, the drive transmission member 21 and the horizontal shafts 211, 311 are caused to rotate and the gearboxes 200, 300 in turn cause the vertical screw shafts 35 of the respective legs 30 and 30 to rotate so that the height of those legs which support the desk- or work-top member 10 are adjusted simultaneously. Since the gearbox 200 includes another pinion gear and associated horizontal shaft 211', the drive transmission member 22 and the shaft 311' are also caused to rotate and the height of leg 30' is also adjusted by means of the gearbox 300'.

A further advantageous feature of the height adjustment system of the invention is that the legs 30 include self-adjusting linear bearings 40 which will be described with particular reference to FIGS. 18 to 26.

The linear bearings 40 for the height adjustable legs 30 each comprise a bearing body 400 located between the relatively movable inner steel tube 34 and the outer hollow column 31 of the leg 30, a pair of upper and lower hollow wedge members 410, 420 and an elongate member spoke 430 extending through and connecting the wedge members 410, 420.

The bearing body 400 is preferably formed from a low friction plastics material, such as nylon, and has wider upper and lower bearing regions 401 and 402 and a narrower central region 403.

The bearing body 400 is secured to the upper end of the column 31, for instance by fixing bolts or screws 406, and the outer surfaces 404 of the wider upper and lower regions 401 and 402 engage with the internal surface of the column 31. The internal surfaces 407 of the upper and lower regions 401 and 402 are arranged to provide bearing surfaces for the external surface of the inner steel tube 34 so as to allow the tube 34 to move vertically relative to the column 31.

The upper and lower regions 401 and 402 each have at least one vertically extending tapered rectangular aperture 408 for receiving a respective one of the wedge members 410, 420 which are provided for expanding the upper and lower regions 401, 402 when adjustment for wear is required.

The upper wedge member 410 is of tapered rectangular section having a wider upper end 411, a narrower lower end 412 and a vertical bore 413 extending through the wedge member 410. The lower wedge member 420 is of similar form having a wider lower end 421, a narrower upper end 422 and a vertical bore 423 extending through the wedge member 420. Each wedge member 410, 420 is arranged to taper outwardly from its narrower end 412, 422 to its wider end 411, 421 at an angle which is less than the friction angle of the material from which the wedge members are formed.

The wedge members 410, 420 may be formed from any convenient material, but are preferably formed from a low-friction plastics material such as nylon or polyethylene. In a preferred embodiment the wedge members 410, 420 taper at an angle of about 6.5° to the vertical, which is substantially less than the friction angle for nylon of about 21°.

The elongate spoke member 430 extends into and is secured to the lower wedge member 420 preferably by providing a threaded portion 431 at the lower end of the spoke member 430 which acts as a self-tapping screw. The spoke member 430 extends upwardly through the bore 413 in the upper wedge member 410 in such a manner that the upper wedge member 410 is moveable relative to the spoke member 430. A spoke nut 432 is provided on the upper end of the spoke member 430 and a spring 433 is provided between the spoke nut 432 and the wider upper end 411 of the upper wedge member 410 to urge the upper wedge member 410 downwardly into the aperture 408 in the upper region 401 of the bearing body 400.

Figure 21:
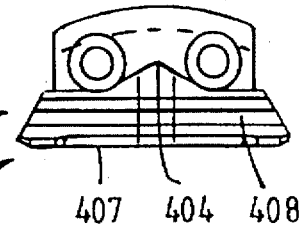
FIG. 21 is a plan view of the bearing body.
Figure 20:
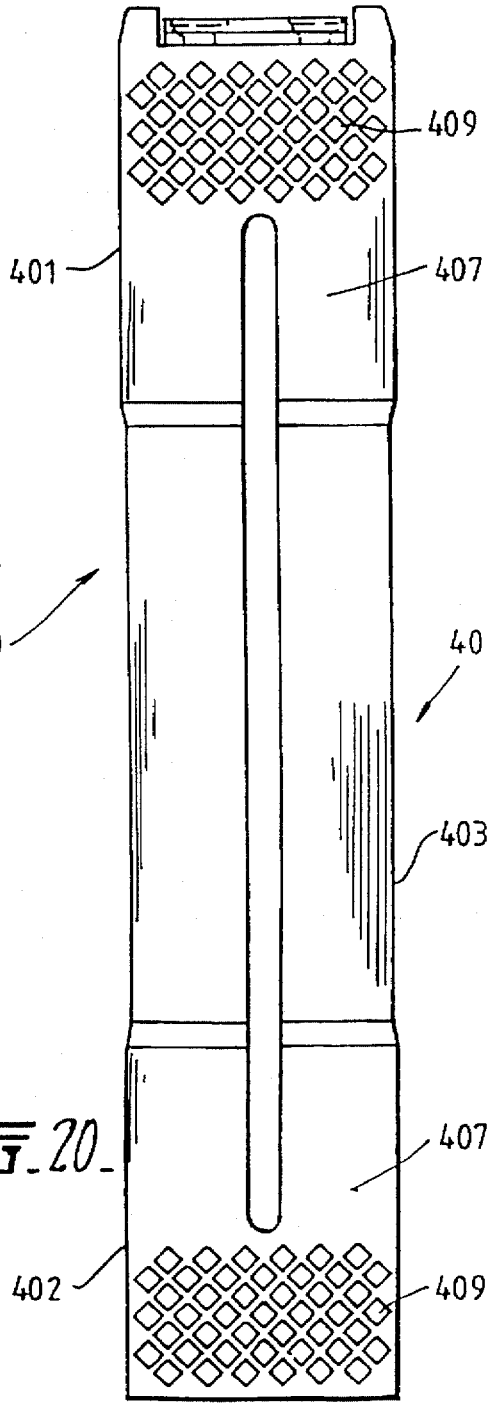
FIG. 20 is an opposite side view of the bearing body for the linear bearing assembly of FIG. 19.
Figure 22:
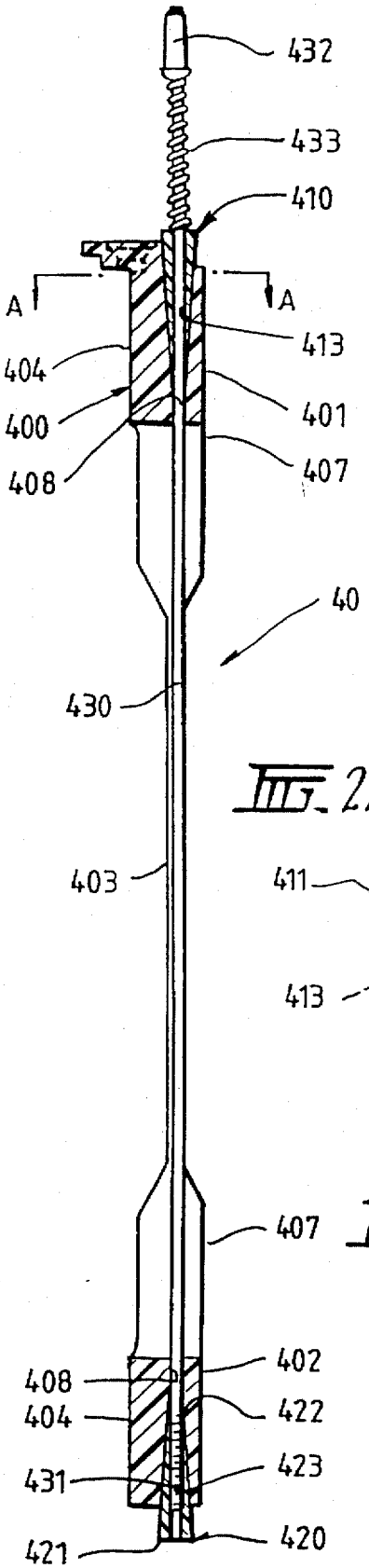
FIG. 22 is a vertical section through the linear bearing assembly.
Figure 23:
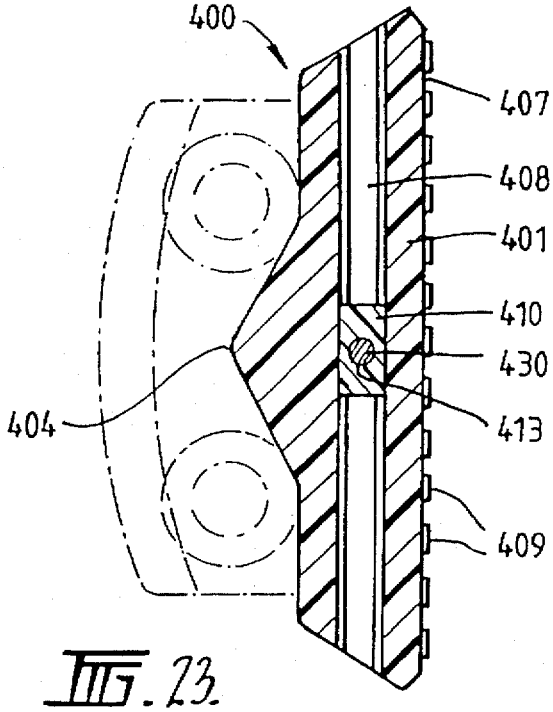
FIG. 23 is a section on the line A—A of FIG. 22.
Figure 24:
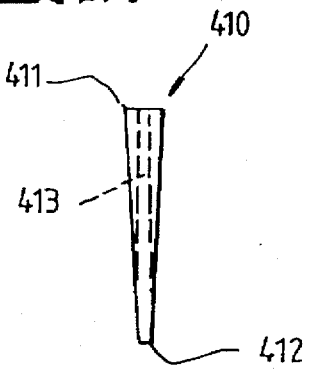
FIG. 24 is an end view of a wedge member for the linear bearing assembly.
Figure 25:
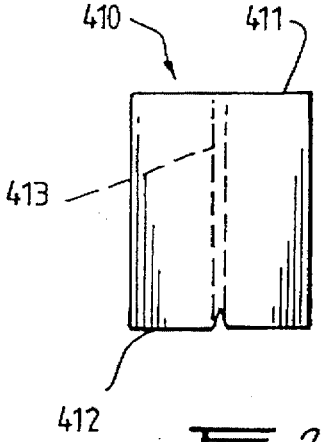
FIG. 25 is a side view of the wedge member of FIG. 24.
Figure 26:
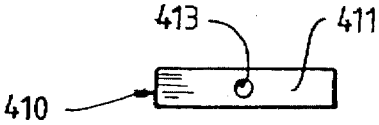
FIG. 26 is a plan view of the wedge member.

Whilst only one linear bearing 40 is specifically illustrated in FIG. 18, it will be appreciated that a plurality of circumferentially spaced bearings 40 may be conveniently provided between the inner tube 34 and the outer column 31 of the leg. As shown in FIG. 21, the internal surfaces 407 of the upper and lower regions 401, 402 of the bearing body 401 are generally planar surfaces adapted to provide bearing surfaces for an inner tube member 34 having flat outer surfaces, such as an inner tube member of square-section. It will, however, be appreciated that the shape of the bearing surfaces may be varied to suit inner tube members of different shapes. For instance, at least one bearing body with arcuate bearing surfaces may be provided for a cylindrical inner tube member. As shown in FIG. 20, each bearing surfaces 407 may be provided with a tread pattern of diamonds 409 raised between 0.1 and 0.25 mm from the remainder of the bearing surface 407 to provide a longer lasting bearing surface.

In use, the linear bearings 40 provide only a light static preload between the telescopically movable inner tube member 34 and the outer column 31 and therefore allow an easy linear motion between those parts. They are also fully self-adjusting to ensure that no free-play between the inner and outer members 34 and 31 occurs as the bearing surfaces 407 wear. Adjustment is achieved automatically because as the bearing surface 407 wear the upper wedge member 410 moves downwardly under the influence of the spring 433 to expand the upper region 401 of the bearing body 400 and the spring 433 also causes the lower wedge member 420 to move upwardly to expand the lower region 402 of the bearing body 400. Since the angle of the wedges is below the friction angle for the material of the hearing body, the wedges are prevented from being ejected from the bearing body under the effect of externally applied loads and the wedges also prevent excessive generation of preloads across the main bearing surfaces. The rigid link provided by the spoke 430 also permits easy assembly and disassembly of the lower wedge 420 and lower region 402 of the bearing body 400.

The self-adjusting bearing assembly of the invention therefore provides automatic compensation for wear ensuring smooth operation and long service life for the height adjustable leg.

It will be appreciated that various modifications and alterations may be made to the embodiment described above without departing from the scope or spirit of the present invention which is defined in the accompanying claims.

I claim:

1. A height adjustment system for a desk or workstation comprising a top member and a plurality of height adjustable legs, each leg comprising a first leg part adapted to stand on a floor surface, and a second leg part adapted to be fixed to said top member, said second leg part being movable relative to said first leg part in a substantially vertical direction, said second leg part including a gearbox housing containing a crown gear rotatable about a substantially vertical axis and at least one pinion gear engageable with said crown gear and a rotatable about a substantially horizontal axis, said gearbox housing containing at least one ball bearing race assembly provided between said gearbox housing and at least one of said gears, wherein the gearbox housing of at least one of said height adjustable legs includes a plurality of pinion gears one of said plurality of pinion gears being connected to drive means for rotating said pinion gear and another of said plurality of pinion gears being connected by drive transmission means to the pinion gear of another height adjustable leg of the system.

2. A height adjustable system according to claim 1 wherein said at least one ball bearing race assembly includes a first bearing race member having a substantially part-spherical concave surface, a second bearing race member having a substantially part-spherical concave surface and a plurality of ball bearings received between said substantially part-spherical concave surfaces.

3. A height adjustable system according to claim 2 wherein said first and second bearing race members are formed from a low-friction plastics material.

4. A height adjustable system according to claim 1 wherein said gearbox housing comprises a housing base member and a gearbox cover member.

5. A height adjustable system according to claim 4 wherein said gearbox housing includes a crown gear ball bearing race assembly between said housing base and said crown gear, said crown gear ball bearing race assembly including a bearing race member having substantially part-spherical concave bearing surface, a substantially part-spherical concave bearing surface provided on said crown gear, and a plurality of ball bearings received between said substantially part-spherical concave bearing surfaces.

6. A height adjustable system according to claim 5 wherein said bearing race member of said crown gear bearing race assembly is substantially dish-shaped and is retained in a complementary shaped recess in said housing base.

7. A height adjustable system according to claim 1 wherein the second leg part includes a generally vertically extending rotatable shaft on which said crown gear is mounted, said rotatable shaft having a screw-threaded portion, and said first leg part includes a nut engaged with said screw-threaded portion, whereby rotation of said crown gear causes said second leg part to move substantially vertically relative to said first leg part.

8. A height adjustable leg for a desk or workstation, the leg comprising a first leg part adapted to stand on a floor surface, and a second leg part adapted to be fixed to a top member of said desk or workstation, said second leg part being movable relative to said first leg part in a substantially vertical direction, said second leg part including a gearbox housing containing a crown gear rotatable about a substantially vertical axis and at least one pinion gear engageable with said crown gear about a substantially horizontal axis, said gearbox housing containing at least one ball bearing race assembly provided between said gearbox housing and at least one of said gears, wherein the second leg part includes a generally vertically extending rotatable shaft on which said crown gear is mounted, said rotatable shaft having a screw-threaded portion, and said first leg part includes a nut engaged with said screw-threaded portion, whereby rotation of said crown gear causes said second leg part to move substantially vertically relative to said first leg part, and wherein said crown gear is of hollow form having a bevel gear portion, an upper shaft portion extending upwardly from said bevel gear portion and a bore adapted to receive the upper end of said rotatable shaft for mounting said crown gear on said rotatable shaft.

9. A height adjustable leg according to claim 8 wherein said gearbox housing includes a housing base member and a gearbox cover member, and a ball bearing race assembly between said upper shaft portion of said crown gear and said gearbox cover member.

10. A height adjustable leg according to claim 9 wherein said ball bearing race assembly comprises a first bearing race member mounted on said upper shaft portion of said crown gear and having a substantially part-spherical concave bearing surface, a second bearing race member receivable within a recess in said gearbox cover member and having a substantially part-spherical concave bearing surface, and a plurality of ball bearings received between said substantially part-spherical concave bearing surfaces.

11. A height adjustment leg according to claim 8 wherein said first leg part comprises a substantially vertical extending column and a plurality of generally horizontal extending feet are secured to the lower and of said column.

12. A height adjustment system for a desk or workstation comprising at least one height adjustable leg in accordance with claim 8, a generally horizontally extending top member affixed to said second leg part of said at least one leg, and drive means connected to one of said pinion gears of said leg for rotating said pinion gear to cause said second leg part and said top member to move substantially vertically relative to said first leg part of said leg.

13. A height adjustable leg for a desk or workstation, the leg comprising a first leg part adapted to stand on a floor surface, and a second leg part adapted to be fixed to a top member of said desk or workstation, said second leg part being movable relative to said first leg part in a substantially vertical direction, said second leg part including a gearbox housing containing a crown gear rotatable about a substantially vertical axis and at least one pinion gear engageable with said crown gear and rotatable about a substantially horizontal axis, said gearbox housing containing at least one ball bearing race assembly provided between said gearbox housing and at least one of said gears, wherein said at least one pinion gear is provided on a generally horizontally extending rotatable shaft adapted to be connected to drive means for rotating said rotatable shaft, and said pinion gear comprises a bevel gear portion and a spigot portion for mounting said pinion gear on said rotatable shaft, said pinion gear ball bearing race assembly comprising a first bearing race member mounted on said spigot portion of said pinion gear and having a substantially part-spherical concave bearing surface, a second bearing race member having a substantially part-spherical concave bearing surface, and a plurality of ball bearings received between said part-spherical concave bearing surfaces, and wherein said gearbox housing includes a housing base member, a gearbox cover member and a pinion gear ball bearing race assembly, and said bearing race member is located in position by being partly received in a recess in said housing base member and partly received in a recess in said gearbox cover member.

14. A height adjustment system for a desk or workstation comprising at least one height adjustable leg in accordance with claim 13, and further comprising a generally horizontally extending top member affixed to said second leg part of said at least one leg, and drive means connected to one of said pinion gears of said leg for rotating said pinion gear to cause said second leg part and said top member to move substantially vertically relative to said first leg part of said leg.

15. A height adjustable leg for a desk or workstation, the leg comprising a first leg part adapted to stand on a floor surface, and a second leg part adapted to be fixed to a top member of said desk or workstation, said second leg part being movable relative to said first leg part in a substantially vertical direction, said second leg part including a gearbox housing containing a crown gear rotatable about a substantially vertical axis and at least one pinion gear engageable with said crown gear and rotatable about a substantially horizontal axis, said gearbox housing containing at least one ball bearing race assembly provided between said gearbox housing and at least one of said gears, wherein the second leg part includes a generally vertically extending rotatable shaft on which said crown gear is mounted, said rotatable shaft having a screw-threaded portion, and said first leg part includes a nut engaged with said screw-threaded portion, whereby rotation of said crown gear causes said second leg part to move substantially vertically relative to said first leg part, and wherein said second leg part includes a generally vertically extending tubular member surrounding said rotatable shaft, and a pair of low friction half nuts are received on said screw-threaded portion of said shaft and attached to said tubular member.

16. A height adjustable leg for a desk or workstation, the leg comprising a first leg part adapted to stand on a floor, and a second leg part adapted to be fixed to a top member of said desk or workstation, said second leg part being movable relative to said first leg part in a substantially vertical direction, said second leg part including a gearbox housing containing a crown gear rotatable about a substantially vertical axis and at least one pinion gear engageable with said crown gear and rotatable about a substantially horizontal axis, said gearbox housing containing at least one ball bearing race assembly provided between said gearbox housing and at least one of said gears, wherein said first leg part includes a vertically extending column, said second leg part includes a vertically extending member within said column, and further comprising at least one adjustable linear bearing provided between said column and said vertically extending member.

17. A height adjustable leg according to claim 16 wherein said linear bearing comprises a bearing body fixed to said column and having upper and lower spaced expandable bearing regions each providing a bearing surface for said vertically extending member of said second leg, and upper and lower wedge members received in respective recesses in said upper and lower regions and adapted to expand said regions to accommodate wear of said bearing surfaces.

18. A height adjustable leg according to claim 17 wherein an elongate connecting member is attached to said lower wedge member and extends upwardly between said expandable bearing regions and through a bore in the upper wedge member, said elongate connecting member including spring means for urging said upper wedge member into said respective recess in said upper region of said bearing body, whereby said linear bearing is automatically self-adjusting to compensate for wear of said bearing surfaces.

19. A height adjustable leg for a desk or workstation, said leg comprising:

a first leg part adapted to stand on a floor surface;

a second leg part adapted to be fixed to a top member of said desk or workstation, said second leg part being movable relative to said first leg part in a substantially vertical direction;

and at least one adjustable linear bearing provided between said relatively movable first and second leg parts, said linear bearing comprising a bearing body fixed to one of said leg parts, said bearing body having upper and lower expandable bearing regions providing bearing surfaces for the other of said leg parts, and upper and lower wedge members received in respective recesses in said upper and lower regions for expanding said regions to compensate for wear of said bearing surfaces.

20. A height adjustable leg according to claim 19 wherein the adjustable linear bearing further comprises spring means for urging at least one of said wedge members into the recess in its respective bearing region of said bearing body so that the bearing automatically compensates for wear of the bearing surface of said bearing region.

21. A height adjustable leg according to claim 20 wherein the upper and lower wedge members are connected together in such a manner that the spring means urges both of said wedge members into their respective recesses in said upper and lower bearing regions.

22. A height adjustable leg according to claim 19 wherein the linear bearing further comprises an elongate connecting member attached to said lower wedge member and extending upwardly between said expandable bearing regions and through a bore in said upper wedge member, and spring means received on a portion of said elongate connecting member above said upper wedge member for urging said upper and lower wedge members into their respective recesses in said upper and lower bearing regions, whereby said linear bearing is automatically self-adjusting to compensate for wear of said bearing surfaces.

23. A height adjustable leg according to claim 19, wherein said first leg part comprises a vertically extending column, said second leg part comprises a tubular member movable within said column in a substantially vertical direction, and said bearing body is fixed to said fast leg with said upper and lower expandable bearing regions being located between said column and said tubular member.

24. An adjustable linear bearing for a height adjustable leg having first and second parts which are movable relative to each other in a linear direction, said linear bearing comprising a bearing body adapted to be fixed to one of said relatively movable parts of the device and having first and second longitudinally spaced expandable bearing regions, each bearing region providing a bearing surface for said other part of the device; and first and second wedge members received in respective recesses in said first and second bearing regions and adapted to expand said bearing regions of the bearing body to compensate for wear of said bearing surfaces.

25. A linear bearing according to claim 24 further comprising spring means for urging at least one of said wedge members into its recess in a respective one of said bearing regions so that the bearing automatically compensates for wear of the bearing surface of said bearing region.

26. A linear bearing according to claim 25 wherein the first and second wedge members are connected together in such a manner that said spring means urges both of said wedge members into their respective recesses in said first and second bearing regions.

27. A linear bearing according to claim 24 further comprising an elongate connecting member attached to said first wedge member and extending through a bore in said second wedge member, and spring means received on said elongate connecting member and arranged to urge said first and second wedge members into their respective recesses in said first and second bearing regions, whereby said linear bearing is automatically self-adjusting to compensate for wear of said bearing surfaces of said bearing regions.

28. A linear bearing according to claim 24 wherein said bearing body and said wedge members are formed from a low friction plastics material and said wedge members have an angle of taper less than the friction angle of said low friction plastics material.

* * * * *

UNITED STATES PATENT AND TRADEMARK OFFICE

CERTIFICATE OF CORRECTION

PATENT NO. : 5,685,510
DATED : November 11, 1997
INVENTOR(S) : R.G. Frankish

It is certified that error appears in the above-indentified patent and that said Letters Patent is hereby corrected as shown below:

| COLUMN | LINE | |
|---|---|---|
| [57] | line 17 of text Abstract | "height or two" should read --height of two-- |
| 10 (Claim 1, | 13 line 10) | please delete "a" before "rotatable" |
| 10 (Claim 1, | 18 line 15) | insert --,-- after "gears" |
| 10 (Claim 8, | 66 line 9) | insert --and rotatable-- after "crown gear" |
| 11 (Claim 11, | 32 line 4) | "lower and" should read --lower end-- |

UNITED STATES PATENT AND TRADEMARK OFFICE

CERTIFICATE OF CORRECTION

PATENT NO. : 5,685,510 Page 2 of 2

DATED : November 11, 1997

INVENTOR(S) : R.G. Frankish

It is certified that error appears in the above-indentified patent and that said Letters Patent is hereby corrected as shown below:

| COLUMN | LINE | |
|---|---|---|
| 14 (Claim 23, | 3 line 5) | "fast leg" should read --first leg-- |

Signed and Sealed this

Seventh Day of April, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,685,510

DATED : November 11, 1997

INVENTOR(S) : R.G. Frankish

It is certified that error appears in the above-identified patent and that said Letters Patent is hereby corrected as shown below:

TITLE PAGE, ITEM [73]: "Prima Furniture (Aust)" should read --Schiavello Commercial Interiors (Vic)--

Signed and Sealed this

Twenty-ninth Day of September, 1998

*Attest:*

*Attesting Officer*

BRUCE LEHMAN

*Commissioner of Patents and Trademarks*